United States Patent [19]

Beriger et al.

[11] 4,434,417

[45] Feb. 28, 1984

[54] LIQUID-COOLED POWER RESISTOR AND USE THEREOF

[75] Inventors: Conrad Beriger, Aarau; Ladislav Kucera, Gebenstorf; Paul Schneider, Untersiggenthal; Günther Spittaler, Fislisbach, all of Switzerland

[73] Assignee: BBC Brown, Boveri & Company Limited, Baden, Switzerland

[21] Appl. No.: 374,145

[22] Filed: May 3, 1982

[30] Foreign Application Priority Data

May 21, 1981 [CH] Switzerland ..... 3322/81

[51] Int. Cl.[3] ..... H01C 1/08

[52] U.S. Cl. ..... 338/53; 338/55; 338/61

[58] Field of Search ..... 338/53–55, 338/61, 63

[56] References Cited

U.S. PATENT DOCUMENTS 2,686,245 8/1954 Richardson ..... 338/53 X 2,717,947 9/1955 Kuzniar et al. ..... 338/55

3,300,746 1/1967 Franz ..... 338/55

*Primary Examiner*—C. L. Albritton

*Attorney, Agent, or Firm*—Werner W. Kleeman

[57] ABSTRACT

A liquid-cooled power resistor contains at least one resistive conductor which is arranged in a closed housing directly in de-ionized water employed as the cooling liquid or coolant. The resistive conductor is advantageously secured in diaphragms which not only serve as holding facilities for holding the resistive conductor, but also deflect or turn the cooling liquid. The resistive conductor is normally connected to two terminal pins. There also can be used a third terminal pin which taps the center or mid-point of the resistive conductor, so that there are available two ohmic values of the power resistor. The power resistor ensures for an effective and uniform removal of heat or thermal energy and possesses a high thermal capacity. The arrangement has a low inductance. The power resistor is particularly suitable for the wiring of thyristors in static converter installations.

7 Claims, 4 Drawing Figures

LIQUID-COOLED POWER RESISTOR AND USE THEREOF

BACKGROUND OF THE INVENTION

The present invention relates to a new and improved construction of a liquid-cooled power resistor containing at least one resistive conductor arranged within a housing, and further pertains to the use of the liquid-cooled power resistor of the invention.

Liquid-cooled resistors are well known in the electrical arts. A resistor of the aforementioned type has been described and illustrated in the undated brochure of CGS Company, England, entitled "Liquid-cooled Resistor Type HS 600". This prior art resistive conductor is made from a copper-nickel alloy or a chromium-nickel alloy and is wound upon a ceramic core. The cylindrical or drum-shaped ceramic core is mounted in an aluminum housing in which there is integrally cast a stainless steel cooling coil. This resistor therefore possesses an indirect means of heat removal. In order to maintain the inherent timeconstants as low as possible, the number of turns of the resistance wire is restricted to a minimum.

SUMMARY OF THE INVENTION

Therefore, with the foregoing in mind it is a primary object of the present invention to avoid the limitations of the prior art construction of liquid-cooled resistor and to provide a remedy for the same.

Another and more specific object of the present invention aims at the provision of a new and improved construction of a liquid-cooled power resistor which exhibits good heat removal characteristics and, consequently, possesses a high currentcarrying capacity, while being constructionally simple in design.

Yet a further important object of the present invention is directed to a new improved construction of a liquid-cooled power resistor wherein the resistive conductor thereof is designed to have a low inductance.

Now in order to implement these and still further objects of the invention, which will become more readily apparent as the description proceeds, the liquid-cooled power resistor of the present development is manifested by the features that, there is provided at least one resistive conductor which is arranged in a closed housing. The resistive conductor is located directly in a cooling liquid contained within the closed housing.

Some of the more notable advantages which are obtained by means of the invention essentially reside in the fact that, the direct arrangement of the resistive conductor in the cooling liquid, preferably de-ionized water, ensures for an effective and uniform removal of heat, and the thermal capacity is relatively high. Because it is no longer necessary to rigidly attach the resistive conductor, for instance to a ceramic body, there is afforded an appreciably easier choice of materials. With the inventive construction of liquid-cooled power resistor, even large differences between the thermal expansion coeffiecients of the resistive conductor and the holding means for retaining such resistive conductor cannot give rise to mechanical damage during heating-up. A further advantage resides in the fact that, it is possible to attain a design having a low inductance, for instance by the provision of a serpentine or meandering arrangement of the resistive conductor.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components, and wherein.

DETAILED DESCRIPTION OF THE PREFERRED EMBODIMENTS

Figure 1:
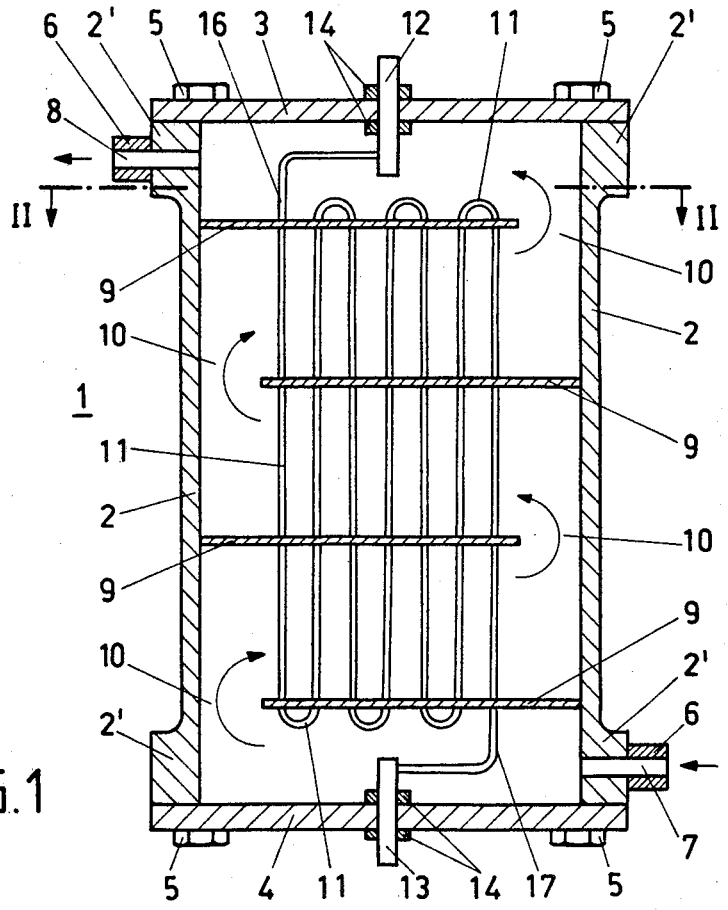
FIG. 1 is a simplified longitudinal sectional view through a first exemplary embodiment of inventive liquid-cooled power resistor containing a resistive conductor which is connected to two terminal pins or equivalent connection elements.

Describing now the drawings, the exemplary embodiment of liquid-cooled power resistor depicted by way of example and not limitation in FIG. 1, will be seen to comprise a housing 1 containing a housing cylinder or cylindrical housing portion 2 which is provided with two flanges 2', and further contains an upper cover plate 3 and lower cover plate 4. The flanges 2' are constructed so as to possess a quadratic or square configuration, so that their corners project past the cylinder or cylindrical housing portion 2 and are employed for establishing the attachment or connection with the cover plates 3 and 4 by any suitable attachment elements, here shown for instance as attachment or fastening screws or threaded bolts 5. The closed housing 1 is provided with two connections 6 or equivalent structure for suitable coolant, here for example de-ionized water. At the lower connection 6 there is provided an inlet bore or opening 7, and at the upper connection 6 there is provided an outlet bore or opening 8 for the respective infeed and outfeed of the de-ionized water or other suitable cooling liquid. The arrows shown in FIG. 1 schematically represent the direction of flow of such de-ionized water. Secured internally of the closed housing 1 are four diaphragms or baffles 9 or equivalent structure. These diaphragms 9 alternately leave free at the left and right side of the internal compartment of the housing 1, as best seen by referring to FIG. 1, the respective throughflow cross-sectional regions or spaces 10 through which there can flow the de-ionized water which is deflected as it moves from the bottom to the top of the housing 1 by the aforementioned diaphragms or baffles 9. Each of the diaphragms 9 is provided with holes or openings 15, as best seen by referring to FIG. 2. A resistive conductor 11 is guided in a serpentine or meander-like configuration through these holes or openings 15, so that the diaphragms 9 or the like are simultaneously advantageously employed as means for holding and guiding the resistive conductor 11.

Continuing, and again reverting to FIG. 1, it will be seen that there is mounted in the upper cover plate 3 an upper terminal pin or connection element 12, and there is inserted in the lower cover plate 4 a lower terminal pin or connection element 13. The two terminal pins 12 and 13 are retained in place by appropriate nut members 14 or other suitable retention elements, and the external portions of such terminal pins 12 and 13 form the electrical connections. The inner portion of the upper terminal pin 12 is electrically and mechanically connected to the upper end 16 of the resistive conductor 11, and the inner portion of the lower terminal pin 13 is electrically and mechanically connected to the lower end 17 of the resistive conductor 11. In the embodiment under discussion, the ends 16 and 17 of the resistive conductor 11 are pressed into the inner portions of the terminal pins 12 and 13. Of course, it is also possible to use a different type of connection, as is well known in this art, for instance soldering, welding or bolting, by way of example.

In the embodiment under discussion, the cylinder or cylindrical housing portion 2 together with the flanges 2' is made of aluminum. The cover plates 3 and 4 are fabricated from polypropylene. The terminal pins 12 and 13 are thus electrically insulated from one another. The resistive conductor 11 is fabricated from a chromium-nickel alloy, the terminal pins 12 and 13 are fabricated from copper, and the diaphragms 9 are fabricated from polypropylene. The de-ionized water which is here used, by way of example, as the cooling liquid or coolant, flows through the power resistor and is continuously treated in a by-pass operation. It is to be understood, however, that other known and suitable cooling liquids can be used, for instance oil to mention but one further example. Additionally, it is also possible to use other metals, alloys and plastics for constructing the power resistor. If the cylinder 2 is manufactured from an electrically conducting material, then the cover plates 3 and 4 should be manufactured from an electrically insulating material. If the housing 1 is composed completely of metal, then the terminal pins 12 and 13 must be inserted into the cover plates 3 and 4 in a manner such that these terminal pins 12 and 13 are electrically insulated.

Figure 2:
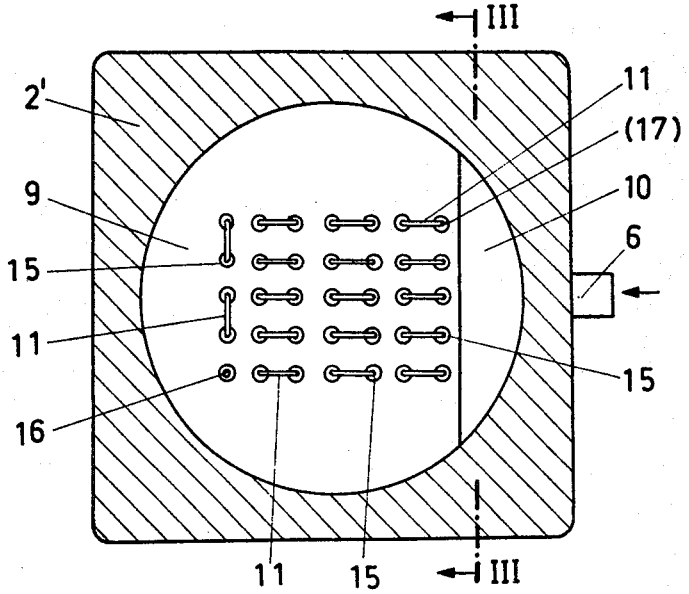
FIG. 2 is a cross-sectional view of the arrangement of FIG. 1, taken substantially along the line II—II thereof.

As will be recalled, the same reference characters used in the embodiment of FIG. 1 have also been employed throughout the remaining Figures to denote the same or analogous components. Turning therefore to the sectional view illustrated in FIG. 2, it will be remembered that such constitutes a section of the arrangement of FIG. 1, taken substantially along the section line II—II thereof. In this FIG. 2 there is visible the upper diaphragm or baffle 9, and also there has been shown at the right-hand side of this diaphragm 9 the throughflow cross-section 10 through which flows the de-ionized water. This FIG. 2 illustrates the manner in which the loops of the resistive conductor 11 run above the diaphragm 9. At the upper right-hand portion of the showing of FIG. 2 there is located that portion (17) of the resistive conductor 11 which is directly connected to the lower end 17 of the resistive conductor 11, whereas a section through the upper end 16 of the resistant conductor 11 has been depicted at the bottom left-hand portion of such FIG. 2. The loops of the resistant conductor 11 prevent any mechanical damage which could possibly arise during the thermal expansion. The holes or openings 15 in the diaphragms 9 are larger in size than the cross-section of the resistive conductor 11. This solution affords a number of notable advantages. Firstly, the assembly of the resistive conductor 11 is easier, and additionally, the resistive conductor 11 can slide in the holes or openings 15 during the thermal expansions and, even at these locations, it is cooled extremely well because small portions of the cooling liquid can flow through these holes 15.

Figure 3:
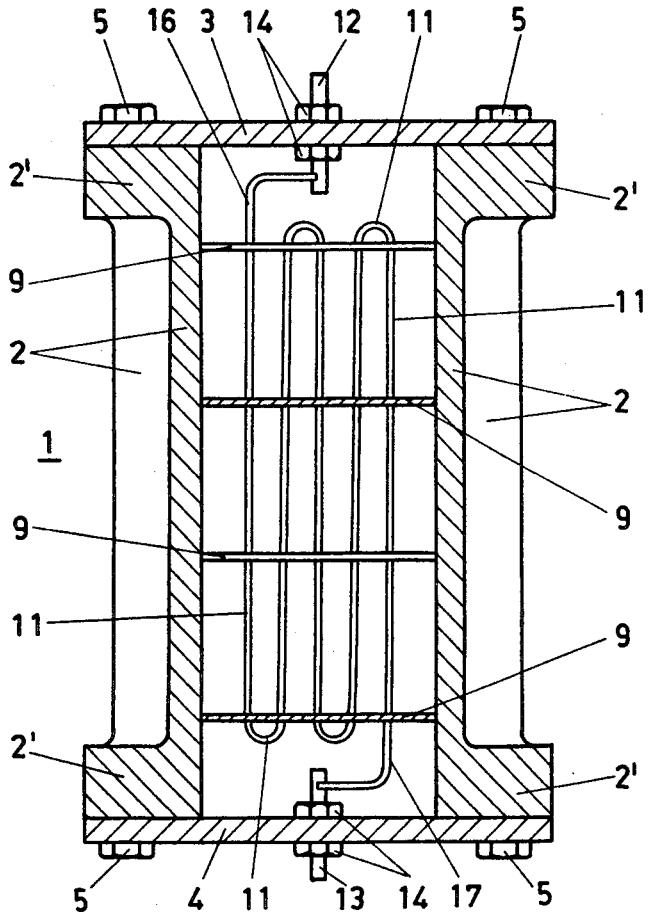
FIG. 3 is a cross-sectional view of the arrangement of FIG. 2, taken substantially along the line III—III thereof.

FIG. 3 is a sectional view of the arrangement of FIG. 2, taken substantially along the section line III—III thereof. Specifically, FIG. 3 depicts the guiding or routing of the resistive conductors 11 at right angles to the guiding or routing of the resistive conductor as shown in FIG. 1. For the sake of clarity in illustration, the resistive conductor 11 has been conveniently depicted in FIGS. 1 and 3 as located in a single plane. However, the three-dimensional arrangement will be evident from the illustration of FIG. 2.

Figure 4:
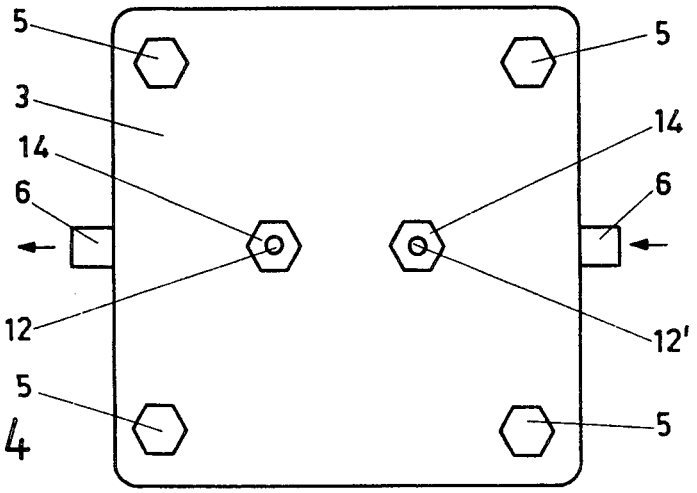
FIG. 4 illustrates a second exemplary embodiment of the invention, wherein the mid-point of the resistive conductor is connected to a terminal pin, and the ends of such resistive conductor are connected to two further terminal pins which have been illustrated in FIG. 4.

Turning attention now to FIG. 4, there is shown therein the upper cover plate 3 of a different exemplary embodiment of the invention. This construction essentially corresponds to that described and illustrated with reference to FIGS. 1 to 3 with the difference, however, that in addition to the upper terminal pin 12 previously described, here there is inserted into the upper cover plate 3 a second upper terminal pin 12'The two ends of the resistive conductor 11 are connected to these terminal pins 12 and 12', whereas the center or mid-point of the resistive conductor 11 is connected to the lower terminal pin 13 which has equally already been described previously in conjunction with the embodiment of FIGS. 1 to 3 but is not particularly visible in the illustration of FIG. 4. As a result of this construction and arrangement there are provided in the housing 1 two sections of the resistive conductor 11, and these two sections can be either connected in series between the terminal pins 12 and 12', or in parallel between the lower terminal pin 13 and the short-circuited terminal pins 12 and 12'. This modified version of the liquid-cooled power resistor affords the possibility of being able to select either of two different resistance values.

The inventive liquid-cooled power resistors are particularly suitable for the wiring of power thyristors in static converter installations.

While there are shown and described present preferred embodiments of the invention, it is to be distinctly understood that the invention is not limited thereto, but may be otherwise variously embodied and practiced within the scope of the following claims. Accordingly,

What we claim is:

1. A liquid-cooled power resistor, comprising:

means defining a closed housing;

at least one resistive conductor arranged in said closed housing;

at least two diaphragms fixed within said closed housing;

said diaphragms possessing holes for the passage of said resistive conductor therethrough, in order to thus form holding means for said resistive conductor;

said diaphragms being fixed within said closed housing so as to obturate only a portion of the cross-section of the closed housing, in order to thereby form free cross-sections;

said closed housing containing a cooling liquid and being provided with means for flowing said cooling liquid through said housing;

said free cross-sections formed by means of said diaphragms in the closed housing being open for the throughflow of said cooling liquid therethrough and being staggered with respect to one another in order to deflect cooling liquid; and said resistive conductor being located directly in said cooling liquid within said closed housing.

2. The liquid-cooled power resistor as defined in claim 1, wherein:

said resistive conductor is arranged in at least two sections with alternating directions of current flow in a manner such that the inductance is low.

3. The liquid-cooled power resistor as defined in claim 1, wherein:

the holes in said diaphragms are of a size larger than the cross-sectional area of the resistive conductor.

4. The liquid-cooled power resistor as defined in claim 1, wherein:

said resistive conductor has a mid-point and opposed end regions;

a terminal pin with which there is connected said mid-point of said resistive conductor; and a respective further terminal pin with which there are connected respective ones of said end regions of said resistive conductor.

5. The liquid-cooled power resistor as defined in claim 1, wherein:

said closed housing contains at least one electrically insulating part.

6. The liquid-cooled power resistor as defined in claim 1, wherein:

said cooling liquid is constituted by de-ionized water.

7. The liquid-cooled power resistor as defined in claim 6, wherein:

said power resistor is employed for the wiring of thyristors in static converter installations.

* * * * *